United States Patent [19]

Barber et al.

[11] Patent Number: 4,539,880

[45] Date of Patent: Sep. 10, 1985

[54] SELF-CONTAINED CORNER RADIUS PUNCH AND DIE MACHINE

[76] Inventors: Eugene F. Barber, 18810 Kingswood Ter., Minnetonka, Minn. 55343; Steven C. Barber, 18900 Highland Ave., Deephaven, Minn. 55391

[21] Appl. No.: 582,837

[22] Filed: Feb. 23, 1984

[51] Int. Cl.[3] ..... B26D 7/01; B26D 3/10

[52] U.S. Cl. ..... 83/467 R; 83/620; 83/917

[58] Field of Search ..... 83/467, 468, 620, 917

[56] References Cited

U.S. PATENT DOCUMENTS 2,656,888 10/1953 Cruzan ..... 83/620 X 3,357,289 12/1967 Thomson ..... 83/620 X 3,516,317 6/1970 Sundquist et al. ..... 83/467

*Primary Examiner*—Donald R. Schran

*Attorney, Agent, or Firm*—James V. Harmon

[57] ABSTRACT

A self-contained, self-actuating corner radius punch and die machine is described including a plurality of spaced apart side-by-side cutting edges arranged in transverse alignment above a worktable. A motive power actuator, e.g., a hydraulic cylinder is mounted below the worktable with its actuator rod extending upwardly through the table and being connected to the punch. A guide is provided for preventing the punch from tilting about a horizontal axis and a stiffening plate is secured to the punch to rigidify the structure and to serve as a support for the guide.

15 Claims, 15 Drawing Figures

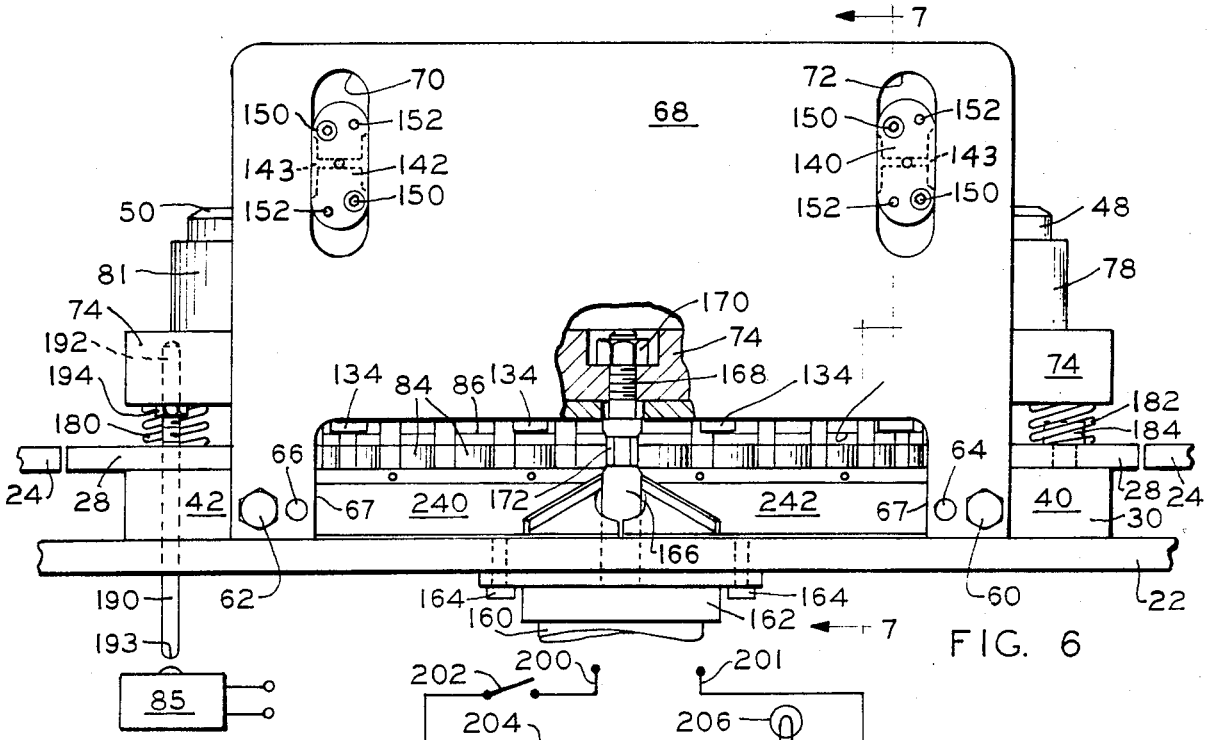
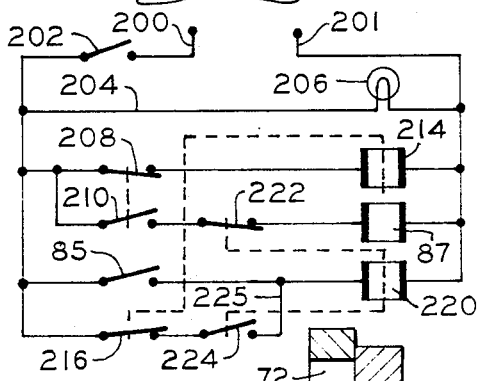
FIG. 10
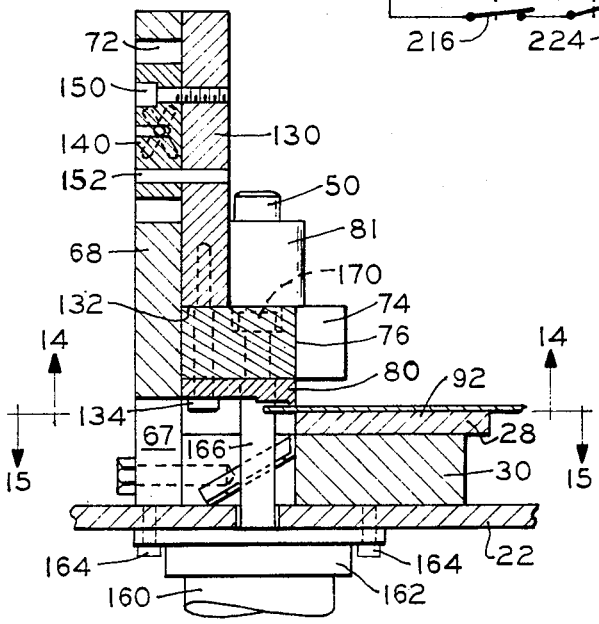
FIG. 7
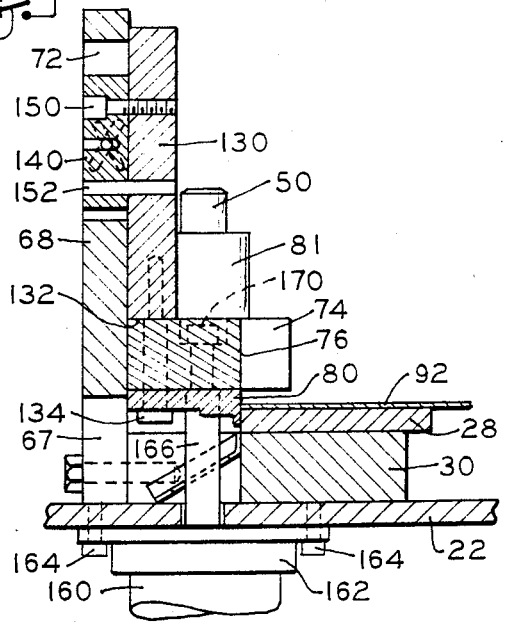
FIG. 8

SELF-CONTAINED CORNER RADIUS PUNCH AND DIE MACHINE

FIELD OF THE INVENTION

The present invention relates to machine tools and more particularly to an improved punch and die machine for removing the corner portions of sheet material to produce round corners of selected sizes.

BACKGROUND OF THE INVENTION

A variety of punch and die assemblies have been previously provided for rounding the corners of a piece of sheet metal by shearing off the corners of the sheet. Ordinarily such a machine will provide only a single corner radius. However, U.S. Pat. No. 3,516,317 describes a punch and die assembly that includes an aligned die and punch each having a plurality of longitudinally spaced apart arcuate cutting edges in side by side relationship with each cooperating pair being of a different size, i.e., different radius from the other pairs. A workpiece is placed between the cutting edges of the desired radius to remove the corner portions and thereby provide a round corner of the selected radius. The present invention is an improvement on the apparatus described in the patent. One of the important shortcomings of the prior device was the requirement for using it in conjunction with a conventional punch press. Thus, to operate the apparatus, it had to be set on the table of the punch press below the power driven reciprocating head. In addition to the large size and bulk of the equipment, the necessity for providing a punch press requires a substantial investment, typically about $15,000. Thus, one objective of the invention is to provide a machine tool that is ready to go at a moment's notice and without having to be set up for operation. However, if it is attempted to make the machine self-actuating, there is a tendency for the punch to tilt when the shearing operation is conducted at either extreme end of the machine. A further shortcoming of prior devices was the possibility for the punch to be deflected or bend under stress. A further deficiency was the possibility for incorrectly positioning the guide bar used to align the work. This resulted from the lack of any reliable provision for preventing locating pins from being inadvertently placed in the wrong locating holes when the guide bar was used.

These and other more detailed and specific deficiencies and provisions for overcoming them will be apparent to those skilled in the art through an understanding of the following summary and detailed description in which the invention is set forth by way of example with reference to the drawings.

SUMMARY OF THE INVENTION

The present invention provides an improved multiple corner punch and die machine which is self-contained, self-actuating and independently operable. A supporting framework is provided which includes a die support at its upper end. The die support includes a die shoe. A motive power actuator means is mounted at the top of the framework below the die support. The motive power actuator includes an actuator rod that extends upwardly past the die shoe and is connected to a punch mounted above the die shoe. A die is mounted on the die shoe below the punch and each of the punch and die includes a plurality of side by side longitudinally spaced apart arcuate cutting edges positioned in cooperating relationship with each cooperating pair of edges which form part of the die and punch coinciding in shape. The die is mounted for vertical reciprocal movement above the die and in aligned relationship to shear off the corners of the workpiece placed between them. A dual guide is preferably provided to maintain relative alignment between the punch and the die. The guide means comprises a first pair of laterally spaced apart parallel vertically disposed guide post and bushing assemblies operatively connected between the punch and the die at opposite ends thereof. The second guide means comprises a fixed guide assembly attached to the die base including a pair of laterally spaced vertically disposed guide grooves and a pair of vertically disposed laterally spaced apart gibs with parallel side edges connected rigidly to the punch and mounted for sliding engagement within the groove. During operation, the motive power actuator means functions to draw the actuator rod in a downward direction thereby forcing the punch downwardly toward the die and die shoe causing the cutting edges of the punch and cooperating die to shear off the corner of the workpiece. As this takes place, the first guide while allowing movement along a vertical axis, restrains the punch from moving horizontally in any direction relative to the die. The second guide means restricts motion by preventing rotation of the punch about a horizontal fore and aft axis.

The invention will be better understood by reference to the following detailed description setting forth one form of the invention by way of example.

THE DRAWINGS

FIG. 6 is a rear elevational view partially broken away to show the attachment of the actuating rod with the punch and shoe.

FIG. 7 is a transverse vertical sectional view taken on line 7—7 of FIG. 6 with the punch raised to the open position showing a piece of work in place before being cut.

FIG. 8 is a vertical sectional view taken on line 7—7 of FIG. 6 as it appears when the punch has been lowered and the workpiece has been cut.

FIG. 10 is a schematic wiring diagram of the apparatus.

DETAILED DESCRIPTION OF THE PREFERRED EMBODIMENTS

Refer now to FIGS. 1–5.

Figure 1:
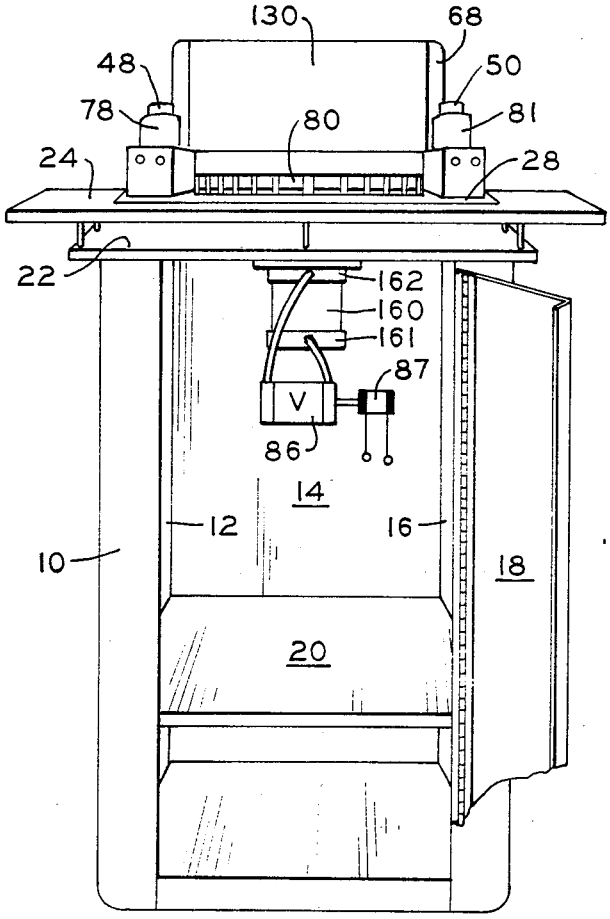
FIG. 1 is a front perspective view of the self-contained self-actuating punch and die apparatus in accordance with the invention.
Figure 3:
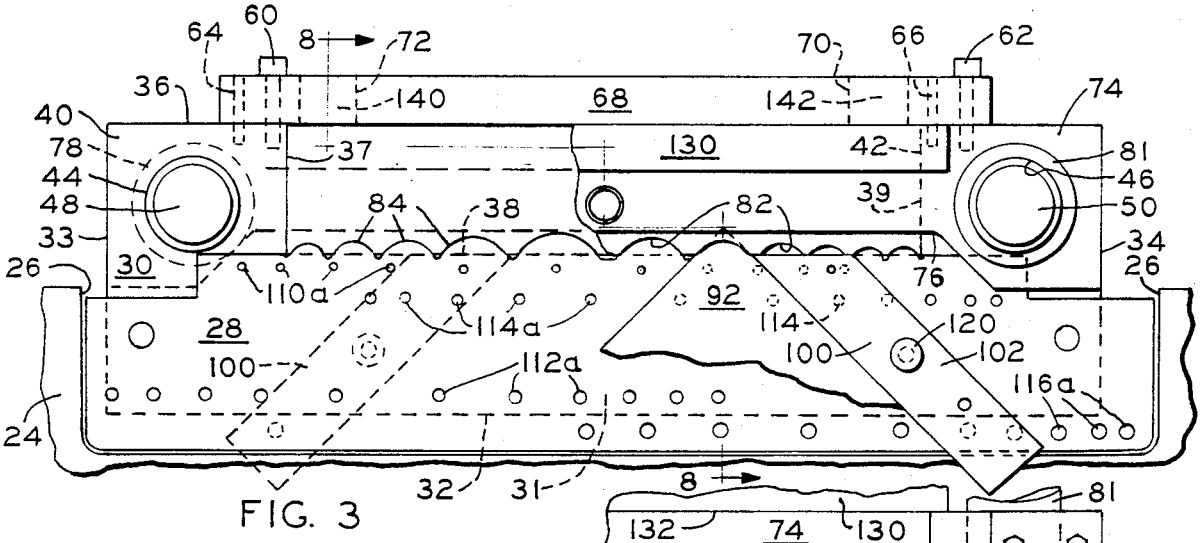
FIG. 3 is a top plan view of the punch and die assembly with the punch unit broken away on the left side to show the die portion at the left as it appears with the punch removed.
Figure 5:
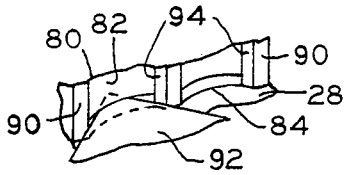
FIG. 5 is a partial perspective view showing the relationship of the punch and die in readiness to shear off the corner of the workpiece.
Figure 4:
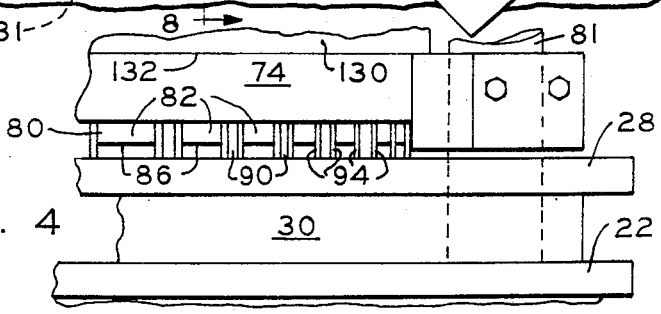
FIG. 4 is a partial front elevational view of the punch and die assembly showing the punch in its elevated position.

The apparatus includes a supporting framework which in this instance consists of a cabinet 10 having vertically disposed walls 12, 14 and 16 and a door 18 in the front. Within the cabinet 10 is provided one or more shelves 20 to be used for supporting supplies or components such as hydraulic pumps or other source of hydraulic fluid under pressure (not shown). At the top of the framework and secured rigidly to the upper edge of the cabinet is a base plate 22 generally rectangular in shape as seen from above. Spaced above the base plate 22 is a table top 24 also generally rectangular in configuration including a cutout 26 of just the proper size to contain the die 28 which will be described below. The table top 24 serves as a support surface for the workpiece during operation and it is on this surface that the workpiece is laid when the shearing operation is to be performed. Secured rigidly to the base plate 22 in any suitable manner as by means of bolts (not shown) is a die shoe 30 formed from thick metal bar stock of an inch or more in thickness. It includes a center section 31 having a front edge 32, parallel side edges 33 and 34, a rear edge 36 and a center section which is cut away to provide an opening for carrying away chips and slugs. The edges of the cut-away section are designated 37, 38 and 39 in FIG. 2. As best seen in FIGS. 3, 7 and 8 the die 28 rests upon the center part of the die shoe. The die shoe includes a pair of parallel laterally spaced apart arms 40 and 42 that are bored at 44 and 46 to receive laterally spaced apart vertically disposed parallel guide posts 48 and 50 which are press fitted into the bored openings. The posts 48 and 50 which, together with their linear bushings that will be described below, serve as a first guide means for the punch and the punch shoe to be described below. It will be thus seen that the die shoe 30 is generally U-shaped in configuration and the legs 40 and 42 on either side of the center opening support the posts 48, 50. Connected rigidly to the die shoe by means of bolts 60, 62 and alignment dowels 64, 66 is a vertically disposed generally rectangular back plate 68 having a pair of parallel vertically disposed laterally spaced apart guide openings 70 and 72 which will be described more fully below. Mounted above the die and die shoe for vertical reciprocation on the posts 48 and 50 is a punch shoe 74 composed of a thick metal plate for the most part of generally rectangular configuration having the center section cut away at 76 (FIGS. 1 and 3). Bolted or otherwise rigidly secured to the punch shoe on either end thereof are a pair of laterally spaced apart vertically disposed parallel bushings 78 and 81 each mounted above a bored opening of just the proper size to accommodate one of the stationary posts 48 or 50 so that during operation the bushings slide up and down on the posts and cooperate during use to serve as a means for locating the punch and the punch shoe relative to the die and prevent motion thereof in any direction within a horizontal plane.

Plate 67 is provided with a downwardly facing recess that serves as an outlet for chips that are cut from the workpiece.

Figure 9:
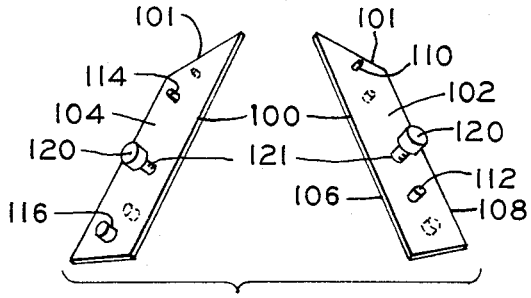
FIG. 9 is a perspective view showing both the top and bottom of the guide bar in alternate positions as adapted for use either upright or inverted.
Figure 2:
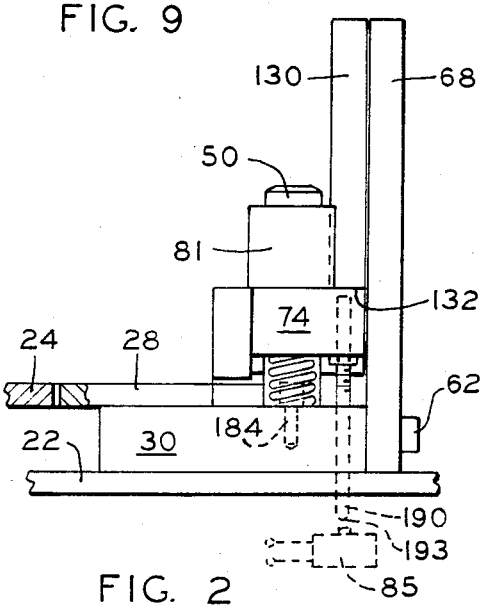
FIG. 2 is a side elevational view of the upper portion of the punch and die machine on an enlarged scale relative to FIG. 1.

Suitably rigidly secured to the bottom of the punch shoe 74 is a punch 80. As seen from above, the punch is provided with a plurality of adjacent recesses 82 aligned laterally in side by side relationship. Positioned below the recesses 82, the die 28 is provided with a plurality of adjacent side by side rearwardly extending arcuate projections 84 each one of which is complementary in size and shape to the shape of the cooperating recess. The die 80 is provided with a plurality of parallel horizontally extending downwardly opening grooves 86 on its lower surface, each one of which is aligned with one of the recesses 82. Thus, each one of the arcuate recesses 82 is aligned with and communicates with one of the horizontally disposed rearwardly extending grooves 86 in the bottom of the punch. Between the grooves are provided downwardly extending transversely spaced apart teeth 90 that extend below the upper edge of the die 28 when the apparatus is open. This will help to keep the punch and die in alignment and will prevent the arcuate cutting edge of the punch from striking the arcuate cutting edge of the die. Thus, the teeth 90 act as stops to help locate the punch relative to the die and also help locate the corner of the workpiece 92 (FIGS. 3 and 5) in the proper place between the cutting edges of the die and the punch. By keeping the teeth 90 engaged at all times with the die 28, the punch cannot be damaged by coming in contact with the die. The extreme ends of each of the recesses 82 are provided with chamfered edges 94. Each of the chamfered edges is typically positioned 45° from the front-to-rear center line of each recess. Accordingly, the chamfered edges 94 provide flat surfaces which are tangent to the radius of its associated recess. In this way, the corner of the workpiece can be properly aligned with the cutting edge of the die and punch. To further assist in alignment, a guide bar is provided as will be described below. The guide bar 100 shown in FIGS. 3 and 9 includes a top surface 102 and a lower surface 104. The bar 100 has the shape of a parallelogram with parallel edges 108 and 106 which serves as a guide. The guide bar also includes a locating edge 101. Between the edges 106 and 101 is an included angle of 45°. The first set of upwardly extending pins 110, 112 are sized and positioned to fit into a first set of holes **110*a*, 112*a* while a second set of downwardly extending pins 114, 116 on the lower surface 104 of the bar are of a different size than the other pins and are positioned and sized to fit into a different set of openings 114*a*, 116*a*. By way of example, the openings 110*a* may be 3/16" diameter; openings 114*a*, $\frac{1}{4}$" diameter; openings 112*a*, $\frac{3}{8}$" diameter; and openings 116*a*, 5/16" diameter. It should be noticed that the locating pins are positioned to one side of the center line of the guide bar 100. This provides an important advantage in reducing the chance for one set of holes to interfere with the other set at each extreme end of the die. Accordingly, the sets of locating holes can be spaced further apart from one another. By providing two sets of openings of different sizes and two sets of pins, one set of which projects upwardly and the other downwardly from the lower surface, the guide bar 100 will always be properly located whether it is used as shown in solid lines in FIG. 3 on the right side of the workpiece or inverted as shown in dotted lines in FIG. 3 on the left side of the workpiece. It will, of course, be understood that the openings 110*a*, 112*a* are properly positioned to align the guide edge 106 with each one of the respective recesses in the punch on the right side thereof whereas the pins 114, 116 are placed in the openings 114***a*, 116*a* will align the guide edge 106 with the left side of the workpiece 92.

The pins 110, 114 nearest the locating edge 101 and the corresponding openings 110*a* and 114*a* are optional. By omitting them, two advantages are achieved; the inner end of the bar 100 is self positioning by virtue of the contact between the locating edge 101 and the punch and production costs are reduced.

The guide bar 100 is also provided with a removable handle 120 having a threaded shank 121 which is screw threaded into an opening in the center of the guide bar. Thus, when the guide bar is to be used in the upright position shown in solid lines in FIG. 3, the handle 120 is screw threaded into the top surface 102 and when it is to be used in the inverted position, the removable handle 120 is unscrewed and remounted in the lower surface 104 of the guide bar.

It can thus be seen that the holes 110*a*, 112*a* as well as the second set of holes 114*a*, 116*a* are aligned diagonally in pairs with respect to each other so that the guide bar 100 can be placed on the die 28 in any one of a number of selected left to righthand positions so that all of the cooperating projections and recesses in the punch and die can be used to form different sized round contours at the corner of the workpiece 92. Typical radii for the punch and die assembly are $\frac{1}{8}''$, 3/16″, $\frac{1}{4}''$, 5/16″, $\frac{3}{8}''$, 7/16″, $\frac{1}{2}''$, $\frac{5}{8}''$, $\frac{3}{4}''$, $\frac{7}{8}''$ and 1″.

Figure 13:
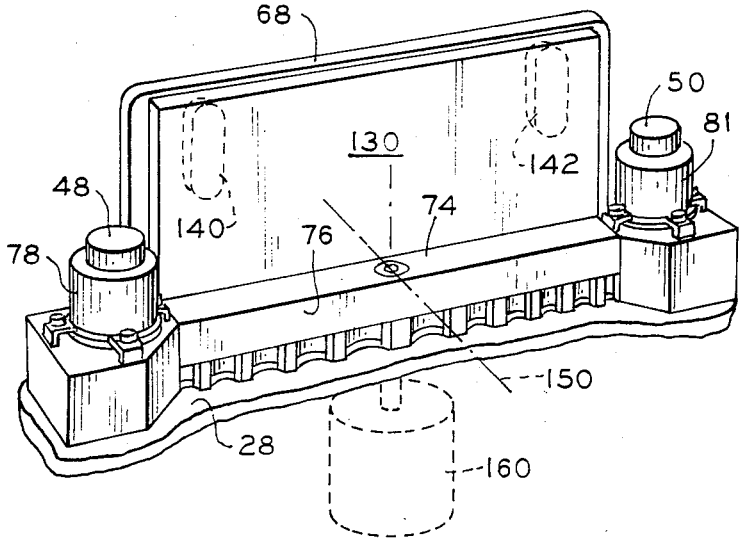
FIG. 13 is a perspective view of the upper portion of the punch and die assembly.
Figure 14:
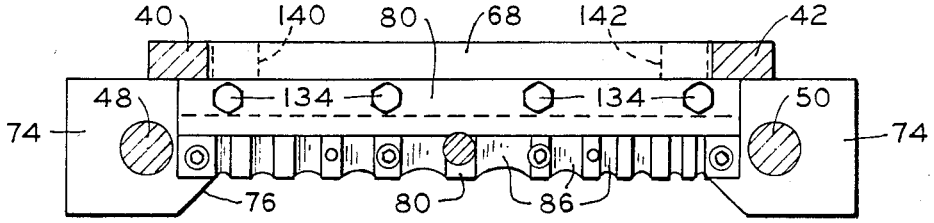
FIG. 14 is a horizontal sectional view taken on line 14—14 of FIG. 7.
Figure 15:
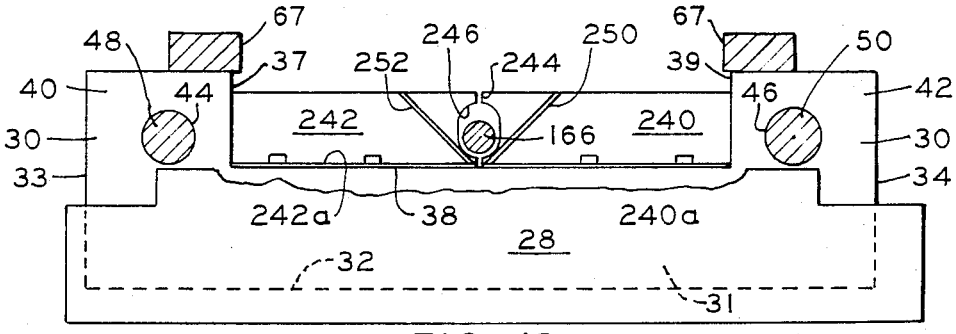
FIG. 15 is a horizontal sectional view as seen from below taken on line 15—15 of FIG. 7.

The second guide means for the punch will now be described particularly with reference to FIGS. 2, 3 and 6–8. As seen in the figures, there is provided immediately adjacent to and in parallel relationship with the vertically disposed stationary back plate 68 a vertically disposed movable front plate 130 of generally rectangular configuration having a lower edge 132 resting on the upper surface of the punch shoe 74. The front plate 130 is normally spaced slightly from the plate 68 but may be in sliding contact therewith if desired. Plate 130 is rigidly secured to the punch shoe 74 in any suitable manner as by means of dowel pins and bolts, one of the bolts being shown at 134 in FIGS. 7 and 8 and in FIG. 6. Mounted on the upper end of the plate 130 are a pair of laterally spaced apart vertically disposed parallel upright gibs 140 and 142 having parallel side edges which are positioned in sliding contact with the side edges of the guide openings 70, 72. The gibs 140, 142 are rigidly secured to the front plate 130 by means of bolts 150 and dowel pins 152. It has been found that, while the bushing and post assemblies 48, 50 are excellent for preventing horizontal motion of the punch relative to the die, they are not particularly effective for preventing the punch from tilting relative to the die on a horizontally disposed front-to-rear axis 150 (FIG. 13). However, the second guide means composed of the gibs and guide openings 70, 72 are surprisingly effective in maintaining alignment and preventing torsion about the axis 150. The front plate 130 also serves as a vertically disposed stiffener for rigidifying the punch and punch shoe thereby preventing bending, warping or deflection thereof, for example, upward deflection of the ends during the shearing operation. The self-contained motive power actuating assembly will now be described with particular reference to FIGS. 1, 6 and 8. As seen in the figures, there is provided a linear motive power means such as a linear hydraulic actuator cylinder 160 having lower and upper ends 161, 162, the latter of which is rigidly secured to the framework of the apparatus, particularly to the base plate 22 by means of fasteners such as bolts 164. The actuator 160 includes a vertically disposed upwardly extending actuator rod that is rigidly attached at its upper end as by means of threads 168 and retaining nut 170 to the punch shoe 74. The actuator rod 166 is provided with a hexagonal cross section at 172 enabling a wrench to be applied to the rod 166 for rotating it to thereby either raise or lower the punch and punch shoe relative thereto for determining the uppermost position thereof when the actuator rod 166 is fully extended, i.e., raised to its uppermost position. Once the proper position is achieved, the nut 170 is tightened, locking the punch shoe 74 in place on the threaded actuator rod 166. The actuator 160 applies force in a downward direction to effect the shearing operation while the return to the open position is accomplished by means of return springs 180, 182 positioned outboard of the posts 48, 50 and in a state of compression between the punch shoes 74 and the die 28. The return springs are held in place by means of internally mounted screw studs 184 that are screw threaded into the die 28. The lowermost or downward position of the punch and punch shoe 74 is regulated by means of the control rod 190 (FIGS. 2 and 6) which is screw threaded into the shoe at 192 and retained with its lower or free end 193 at the desired elevation or vertical height adjustment by means of a lock nut 194. The lower end 193 of the control rod 194 is positioned to engage a microswitch 85 which, when closed, interrupts operation of the actuator and allows the punch to return to its uppermost position. If the control rod 190 is extended, the switch 85 will be operated sooner and the distance of travel wil be reduced.

Refer now to FIG. 10 which illustrates the schematic diagram of a typical electric control circuit wherein the power is provided from the power line through conductors 200, 201, the former of which includes an on/off switch 202 that, when closed, allows power to pass through line 204 to an indicator light 206. During operation, the operator's foot switch, when pressed with the foot, will open switch 208 and close 210 thereby starting the current to solenoid 87 which starts the flow of hydraulic fluid to the top of the cylinder 160 through solenoid operated hydraulic valve 86 and interrupts the operation of solenoid 214 to thereby open normally closed switch 216. Actuator 160 then lowers the punch 80. However, when the microswitch 85 is closed by the control rod 190, the resulting current through solenoid 220 will open switch 222 and close switch 224 thereby interrupting hydraulic fow through solenoid operated hydraulic valve 86 and at the same time locking in solenoid 220 via switch 224 and line 225. This will enable the return springs to again lift the punch 80 to its raised or open position. The foot switch 208, 210 is then ready for repeated operation.

Figure 11:
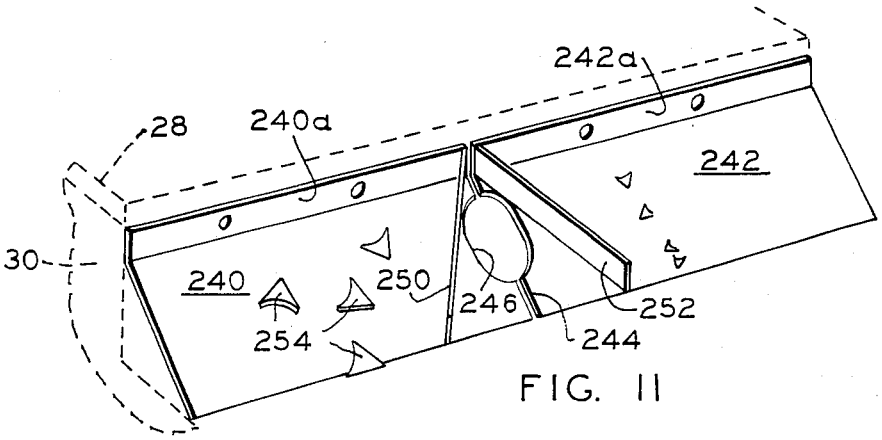
FIG. 11 is a partial perspective view showing the ramp used for deflecting chips and guiding them out of the apparatus.

From the foregoing description, it will be seen that the improved punch and die assembly, in accordance with the present invention, is entirely self-contained and self-actuated through operation of the motive power actuator 160 connected to the framework 10 beneath the punch and die assembly. It can also be seen that the dual guide means for the punch prevents lateral displacement in any direction in the horizontal plane through the effect of the first guide means which consists of the bushings and cooperating guide posts 48, 50 while the second guide means composed of the cooperating gibs 140, 142 and the guide openings 70, 72 provides an effective means for preventing undesired torsion about the horizontal, due for example to a workpiece being introduced to either one extreme end or the other of the apparatus. In addition, the front plate 130 which serves as a stiffener to prevent undesired deflection of the punch. As shown in FIGS. 6, 8 and 11, there is mounted within the open center section of the die shoe 30 a rearwardly and downwardly inclined chip ramp composed of a pair of side by side inclined ramp surfaces formed of sheet metal and indicated at 240 and 242, separated at the center on a line 244 and having a center opening 246 of oblong shape adapted to accommodate actuator rod 166 between them. The ramps have vertically disposed flanges 240*a* and 242*a* which are connected by means of screws or other fasteners to the rear wall of the die shoe 30. Vertically disposed downwardly and outwardly diverging edge dams 250 and 252 are rigidly affixed as by welding to the upper surface of the chip ramps to deflect the chips 254 away from the actuator rod 166.

Figure 12:
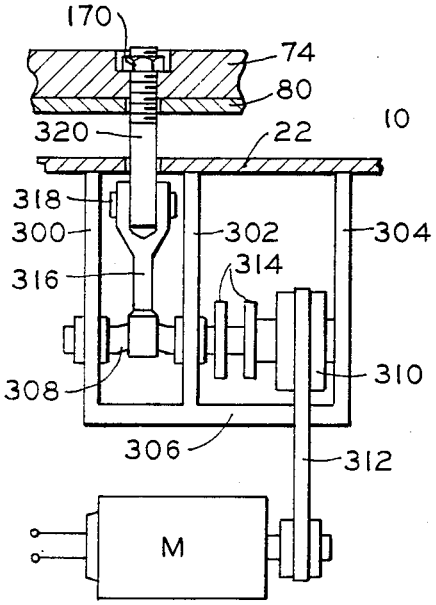
FIG. 12 is an alternative form of a motive power actuator of mechanical construction.

Refer now to FIG. 12 showing an alternative mechanical actuator that includes an actuator framework composed of three vertical supporting plates 300, 302, 304 in a horizontally disposed connecting element 306 secured to their lower ends. Their upper ends are supported in a suitable manner from the machine framework 10 and specifically in this case to the cabinet base plate 22 which functions as a base both for the actuator and the punch and die assembly. A crank shaft 308 is journaled for rotation in the framework and is provided with a fly wheel 310 which is coupled to a drive motor M via a belt and pulley assembly 312. During operation, the fly wheel is coupled to the crank shaft by means of a clutch 314 causing the crank to rotate thereby imparting movement to a connecting rod 316 secured to a throw on the crank shaft 308. The connecting rod 316 in turn is connected through a wrist pin 318 to a reciprocating vertically disposed actuator rod 320 which is screw threaded through a vertically extending bore in the punch shoe 74 to which is secured the punch 80. The clutch 314 is suitably actuated in any manner known in the art to provide 360° of rotation of the crank 308 and hence one cycle of operation to the actuator rod and punch with a suitable provision being made for automatically disengaging the clutch 314 after a full cycle of operation has been completed, i.e., one rotation of the crank 308, while the motor M runs continuously. Any suitable clutch mechanism of the type described known to the art can be used and accordingly no detailed description will be necessary.

The machine is simple to adjust for stock of different gauges. The actuator rod 166 can be turned outwardly so that the fully extended position of the punch is elevated to accommodate stock of a thicker gauge. When this is done the control rod 190 is repositioned as required to reset the lowermost position of the punch as required.

The invention has proved highly successful in actual use. Working models of the machine have been operated successfully at 60 cycles per minute. The machine can be very easily lubricated; for example, grease can be supplied to the gibs 140, 142 through passages 143.

Many variations of the invention will be apparent to those skilled in the art within the scope of the appended claims once the principles of the invention described by way of example hereinabove are understood.

What is claimed is:

1. A self-contained, independently operable corner radius punch and die machine comprising, a supporting framework including a die support having a die shoe at the upper end thereof, a motive power actuator means mounted at the top of the framework below the die support and having an actuator rod extending upwardly past the die shoe, a die mounted on the die shoe, a punch support shoe having a punch mounted thereon above the die and adapted to reciprocate thereabove in cooperative aligned relationship therewith to shear off the portions of a workpiece extending therebetween, the upper end of the actuator rod being connected to the punch shoe, dual guide means for maintaining relative alignment between the punch and the die comprising, a first pair of laterally spaced apart parallel vertically disposed guide post and bushing assemblies operatively connected between the punch and die at each side thereof, a second fixed guide assembly attached to the die base including at least one vertically disposed guiding groove and a gib with parallel side edges connected rigidly to the punch and mounted within the groove with adjacent side surfaces of the gib and the groove in sliding engagement, the operation of the motive power actuator means acting to draw the actuator rod in a downward direction and being adapted to force the punch past the cooperating edge of the die to sever corner portions from the workpiece and the first guide means preventing motion of the punch in a horizontal plane in any direction and the second guide means restricting the motion thereof to prevent the punch from being tilted about a horizontal front-to-rear axis thereof during operation.

2. The apparatus of claim 1 wherein the punch and die include a plurality of cooperating normally vertically spaced apart arcuate pairs of cutting edges, said cutting edges being positioned in side-by-side alignment proceeding transversely of the machine and each cooperating pair being of a selected radius to shear corners from a workpiece to provide a radius of any of several different sizes selected.

3. The apparatus of claim 1 wherein said motive power actuator means comprises a hydraulic cylinder, said framework comprises a cabinet and the cylinder is mounted beneath the punch and die assembly to the lower surface of a base plate having an upper surface to which the die is secured and control means is provided for forcing hydraulic fluid into the hydraulic actuator to draw the punch and punch shoe downwardly to effect a shearing action from below.

4. The apparatus of claim 1 wherein the second guide assembly includes a vertically disposed transversely extending upright stiffening plate, a pair of laterally spaced apart vertically disposed parallel upright gibs rigidly secured to the stiffening plate and a vertically disposed guide plate secured in a fixed position to extend vertically from the die in parallel relationship to the stiffening plate, said guide plate including a pair of vertically disposed laterally spaced apart guide openings positioned to receive the gibs and having guiding surfaces engaged therewith to confine the motion of the punch to a selected path and prevent torsion thereof about a horizontally disposed fore-and-aft axis.

5. The apparatus of claim 1 wherein the die is mounted on a support means having a pair of legs and a cut-away opening therebetween with a chip ramp mounted within the opening in the support means for the die, said chip ramp comprising a ramp surface formed from sheet metal inclined downwardly proceeding away from the die and including a central opening for an actuator rod means extending from the punch downwardly to said motive power actuating means and said chip ramp includes a pair of diverging downwardly extending vertically disposed edge dams positioned on opposite sides of the opening for the actuator rod to guide chips away from the moving actuator rod.

6. The apparatus of claim 1 wherein the motive power actuator means comprises a mechanical actuator supported rigidly upon said framework and including a horizontally disposed crank shaft mounted for rotation, a drive motor connected for imparting rotation to the crank shaft, said crank shaft having a crank throw with a connecting rod coupled thereto at its lower end and a wrist pin operatively secured between an upper end of the connecting rod and the lower end of said actuator rod whereby rotation of the motor is imparted to the crank shaft will impart reciprocation to the connecting rod and actuator rod.

7. The apparatus of claim 6 wherein a clutch means is operatively connected between the drive motor and the crank shaft for intermittently coupling the motor to the crank shaft to turn the crank shaft through a single cycle of 360° and thereupon disengage the motor from the crank shaft, whereby the punch will travel through a single up and down cycle and remain in an open position when the clutch is disengaged awaiting a second cycle of operation.

8. A self-contained, independently operable corner radius punch and die machine for rounding the corners of a workpiece to any one of several selected arcs of different sizes, said apparatus comprising a supporting framework including a die support at the upper end thereof and a die mounted on the support in a horizontal plane, a punch mounted above the die, means aligning the punch and die for relative movement whereby the punch can be reciprocated relative to the stationary die, support means for the punch including a vertically disposed rigidifying and stiffening plate rigidly connected thereto being positioned vertically, a second stationary plate mounted parallel to the stiffening plate, a guide assembly comprising a pair of laterally spaced apart guide openings and gibs operatively associated between the two parallel plates with the gibs having side edges adapted to slidingly engage the side edges of the associated side openings therefor, the spaced apart gib and guide opening assemblies being adapted to prevent torsion of the punch relative to the die about a horizontally disposed fore-and-aft axis, and a motive power actuator means operatively connected between the punch and die and being mounted upon said axis for imparting reciprocation to the punch relative to the die.

9. The apparatus according to claim 8 wherein the punch has a plurality of downwardly extending teeth mounted between a plurality of side by side linearly arranged arcuate cutting edges and the teeth have bottom ends that project below an upper surface of the die when the punch is in an uppermost position to prevent arcuate cutting edges of the punch from striking arcuate cutting edges of the die.

10. The apparatus according to claim 1 wherein a guide bar is provided including a straight guide edge and an adjacent edge at a predetermined acute angle thereto, a first set of upwardly extending locating pins adjacent the ends of the guide bar adapted to project into a first guide means on the die and a second set of downwardly extending guide pins of a size different from the first set of guide pins adapted to extend into a different set of openings of a selected different size provided in the die for locating the guide bar in either an upright or inverted position to thereby locate parts relative to a selected cooperating set of arcuate cutting edges on either the left or the right side thereof.

11. The apparatus according to claim 8 wherein a guide bar is provided having a straight locating edge, a second edge at a predetermined angle thereto to define an acute included angle, a first set of guide means on one face of the guide bar, a second set of guide means on the opposite face of the guide bar, and two sets of cooperating guide means on said apparatus to selectively receive the guide means on the bar to locate the bar in the proper position to guide workpieces between selected cooperating arcuate edges of the die and punch on either the right or the left side of the workpiece.

12. The apparatus according to claim 1 wherein said vertically disposed actuator rod is threaded at its upper end and is screw threaded into a support for the punch, means is provided for selectively adjusting the vertical position of the rod relative to the punch support, and means is provided for locking the rod in a selected vertical position relative thereto to control the open position of the punch when the actuator rod is raised to an upper position.

13. The apparatus according to claim 1 wherein electrically controlled valve means is operatively connected to the actuator for energizing the actuator to draw the punch in a downward direction, electric switch means is wired to the electrically controlled valve means, a control rod is operatively connected to the punch to energize the switch, and the control rod is adjustable to energize the switch at selected positions of the punch by selectively regulating the lowermost position of the punch.

14. A self-contained, and independently operable corner radius punch and die machine comprising, a supporting framework having a punch and die base plate at the top thereof, a stationary die connected to the base plate, a vertically movable reciprocating punch mounted thereabove for movement relative thereto, the punch and die having a plurality of spaced arcuate cooperating pairs of cutting edges coinciding in shape with each other and being distributed in a side-by-side relationship and in transverse alignment, a motive power actuator means mounted upon the supporting framework and being supported thereby, motive power actuator means operatively connected to the punch for reciprocating the punch relative to the stationary die when the actuator is energized, said die being supported upon a generally U-shaped die shoe having a pair of rearwardly extending legs, a portion of the die shoe being cut away between the legs to define a rearwardly facing recess to accommodate the removal of chips severed from a workpiece during operation, a vertically disposed guide plate rigidly secured to the legs and extending upwardly therefrom, said plate having a cut-away opening at the lower edge thereof in alignment with the cut-away recess in the die shoe to facilitate complete removal of the chips, a guide means operatively connected between the guide plate and the punch for restricting the motion of the punch along a vertical axis relative to the die.

15. The apparatus of claim 14 wherein a vertically disposed stiffening plate is rigidly connected to the punch and extends vertically therefrom in a plane parallel to the guide plate and at least one gib is operatively associated between the stiffening plate and the guide plate to define said guide means for restricting the motion of the punch along said vertical axis.

* * * * *